US008106731B2

(12) United States Patent
Yamauchi et al.

(10) Patent No.: US 8,106,731 B2
(45) Date of Patent: Jan. 31, 2012

(54) ELECTROMAGNETIC SWITCH FOR STARTER

(75) Inventors: Hayato Yamauchi, Chiyoda-ku (JP); Haruki Nakayama, Chiyoda-ku (JP); Yasuyuki Yamane, Chiyoda-ku (JP); Yoshihiro Nishikawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 181 days.

(21) Appl. No.: 12/407,485

(22) Filed: Mar. 19, 2009

(65) Prior Publication Data

US 2010/0102905 A1 Apr. 29, 2010

(30) Foreign Application Priority Data

Oct. 23, 2008 (JP) ..... 2008-273243

(51) Int. Cl.
*H01H 67/02* (2006.01)

(52) U.S. Cl. ..... 335/126; 335/131; 307/10.6

(58) Field of Classification Search ..... 335/126–131, 335/251, 255, 256; 307/10.6
See application file for complete search history.

(56) References Cited

U.S. PATENT DOCUMENTS

| | | | | |
|---|---|---|---|---|
| 4,293,835 | A * | 10/1981 | Davis et al. | 335/131 |
| 4,862,123 | A * | 8/1989 | Gray et al. | 335/131 |
| 4,987,396 | A * | 1/1991 | Bogner | 335/126 |
| 6,204,742 | B1 * | 3/2001 | Hisamoto et al. | 335/126 |
| 7,157,996 | B2 * | 1/2007 | Enomoto et al. | 335/132 |

FOREIGN PATENT DOCUMENTS

| | | |
|---|---|---|
| JP | 0612143 | 2/1994 |
| JP | 2002004986 | 1/2002 |
| JP | 2002-048037 A | 2/2002 |
| JP | 2003139025 | 5/2003 |
| JP | 2004-019601 A | 1/2004 |
| JP | 2005127244 | 5/2005 |
| JP | 2006009680 | 1/2006 |
| JP | 2006307757 | 11/2006 |

* cited by examiner

*Primary Examiner* — Bernard Rojas
(74) *Attorney, Agent, or Firm* — Sughrue Mion, PLLC

(57) ABSTRACT

There is provided an electromagnetic switch, for a starter, that is capable of preventing a defect caused by the formation of a leakage circuit between the battery terminal and the motor terminal, even in the case where the electromagnetic switch is flooded with water. On the outer surface of a switch cap, there is provided a diaphragm disposed between the battery terminal and the motor terminal that are arranged in such a way as to be exposed outside the switch cap; the diaphragm is formed in such a way that a wall face thereof that faces one terminal, out of the battery terminal and the motor terminal, which is disposed upper than the other terminal has a protrusive shape.

4 Claims, 4 Drawing Sheets

ELECTROMAGNETIC SWITCH FOR STARTER

BACKGROUND OF THE INVENTION

1. Field of the Invention

The present invention relates to an electromagnetic switch utilized for a starter that starts an engine, and particularly to the structure of the terminal unit thereof.

2. Description of the Related Art

In general, a starter for starting an engine is provided with a starter motor for generating torque, a speed reducer that utilizes an epicyclic gear so as to reduce the rotation speed of the rotor of the starter motor and output the torque, an overrunning clutch provided on an output axle of the epicyclic speed reducer, a pinion that is provided on the output axle along with the overrunning clutch slidably, and a shift lever that slides the overrunning clutch and the pinion along the output axle.

In addition, an electromagnetic switch for a starter is provided in the starter in an integrated manner. The electromagnetic switch for a starter includes an electromagnetic coil that is energized when the key switch of an vehicle is turned on, a plunger that is driven by electromagnetic force exerted on the electromagnetic coil when the electromagnetic coil is energized and travels so as to move the overrunning clutch and the pinion toward a ring gear of the engine, a pair of fixed contacts that are spaced apart from each other and connected with a battery and the starter motor, respectively, and a movable contact that is driven through the travel of the plunger and makes contact with the pair of fixed contacts so as to make a short circuit across the pair of fixed contacts.

The movable contact and the pair of fixed contacts are contained in a switch cap made of an insulative material. The pair of fixed contacts are connected, respectively, with a battery terminal that penetrates the switch cap from inside toward outside and a motor terminal that penetrates the switch cap from inside toward outside. On the outer surface of its axis-direction closed end, the switch cap is provided with a diaphragm disposed between the battery terminal and the motor terminal; a sufficient creepage distance between the battery terminal and the motor terminal is ensured through the diaphragm (e.g., refer to Japanese Patent Application Laid-Open No. 2004-19601).

FIG. 6 is an elevation view of a terminal unit of the foregoing conventional electromagnetic switch for a starter; FIG. 7 is a cross-sectional view of the terminal unit in FIG. 6 in the case where the cross section taken along the line A-A is viewed along the arrow A. As illustrated in FIGS. 6 and 7, a battery terminal 8 and a motor terminal 11 are fixed in a cylindrically formed switch cap 7 in such a way as to penetrate the closed portion that is one end of the switch cap 7 in the axis direction thereof. A battery terminal strip 9 connected with a battery cable 10 and a motor terminal strip 13 connected with a motor lead 14 are connected with the battery terminal 8 and the motor terminal 11, respectively, at the outside of the switch cap 7. Additionally, a battery fixed contact 8*a* and a motor fixed contact 11*a* are adhered and electrically connected to one end of the battery terminal 8 and one end of the motor terminal 11, respectively.

Between the battery terminal 8 and the motor terminal 11, there is situated a diaphragm 70 that is formed on the outer surface of the closed end of the switch cap 7; thus, as described above, a sufficient creepage distance between the battery terminal 8 and the motor terminal 11 is ensured. A wall face 7*a*, of the diaphragm 70, that faces the battery terminal 8 and a wall face 7*b* that faces the motor terminal 11 are formed in a concave shape. In some cases, the wall faces 7*a* and 7*b* of the diaphragm 70 are formed in a planar shape.

The conventional electromagnetic switch for a starter is configured in such a way that the wall face 7*a*, of the diaphragm 70 of the switch cap 7, that faces the battery terminal 8 is formed in a planar shape; therefore, in the case where the electromagnetic switch is installed in a vehicle in such a way that the battery terminal 8 is disposed approximately immediately above the motor terminal 11, the wall face 7*a* of the diaphragm 70 is likely to have a water puddle, due to a flood or the like; accordingly, under such a crucial environment as being intermittently flooded with water for a long time period, there has been a problem that the water puddle overflows into a place between the battery terminal 8 and the motor terminal 11, whereby a leakage circuit, from the battery terminal 8 or the battery terminal strip 9 to the motor terminal 11 or the motor terminal strip 13, is liable to be formed via the diaphragm 70 of the switch cap 7.

Because, from the view point of production through molding a synthetic resin, there exists restriction, which depends on the wall thickness of the diaphragm, on the longitudinal (height) dimension of the diaphragm 70 of the switch cap 7 from the side end surface of the switch cap 7, the diaphragm 70 cannot be elongated to a dimension longer that a predetermined length; in contrast, because being formed of a member the same as the member that is formed in a relatively elongated shape and forms the battery terminal 8, the motor terminal 11 with which the motor terminal strip 13 is connected is formed in a relatively elongated shape, as is the case with the battery terminal 8. Accordingly, as illustrated in FIG. 7, the respective front ends of the battery terminal 8 and the motor terminal 11 that are formed in a relatively elongated shape protrude over the front end of the diaphragm 70 of the switch cap 7, whereby there exists a region where the diaphragm 70 is not situated between the respective front ends of the battery terminal 8 and the motor terminal 11. As a result, there has been a problem that, under such a crucial environment as being intermittently flooded with water for a long time period, a water puddle due to the flood adheres to a place between the battery terminal 8 and the motor terminal 11, whereby a leakage circuit, from the battery terminal 8 to the motor terminal 11 via the diaphragm 70 of the switch cap 7, is liable to be formed.

SUMMARY OF THE INVENTION

The present invention has been implemented in order to solve the foregoing problems in the conventional electromagnetic switch for a starter; the objective thereof is to provide an electromagnetic switch, for a starter, that is capable of preventing a defect caused by the formation of a leakage circuit between the battery terminal and the motor terminal, even in the case where the electromagnetic switch is flooded with water.

An electromagnetic switch for a starter according to the present invention includes an electromagnetic coil that is energized when a key switch is turned on; a plunger that is driven by electromagnetic force produced across the energized electromagnetic coil, thereby traveling in a predetermined direction; a pair of fixed contacts that are spaced apart from each other; a movable contact that travels due to a travel of the plunger and makes contact with the pair of fixed contacts so as to make a short circuit across the pair of fixed contacts; a switch cap that is made of an insulative material and incorporates the pair of fixed contacts and the movable contact; a battery terminal that is connected with one of the pair of fixed contacts and is disposed in such a way as to be exposed outside the switch cap; and a motor terminal that is connected with the other one of the pair of fixed contacts and is disposed in such a way as to be exposed outside the switch cap. The electromagnetic switch for a starter is configured in such a way that electric power is supplied from the battery connected with the battery terminal to a starter motor connected with the motor terminal, when the movable contact makes a short circuit across the pair of fixed contacts, and is characterized in that, on the outer surface thereof, the switch cap is provided with a diaphragm disposed between the battery terminal and the motor terminal; and the diaphragm is formed in such a way that a wall face thereof that faces the battery terminal has a protrusive shape.

An electromagnetic switch for a starter according to the present invention is configured in such a way that, on the outer surface thereof, a switch cap containing a pair of fixed contacts and a movable contact is provided with a diaphragm disposed between a battery terminal and a motor terminal, and the diaphragm is formed in such a way that a wall face thereof that faces the battery terminal has a protrusive shape; therefore, even in the case where the electromagnetic switch for a starter is flooded with water, the water does not remain on the wall face of the diaphragm. Accordingly, a defect, such as an erroneous operation of the starter, caused by a leakage circuit formed between the battery terminal and the motor terminal can be prevented.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
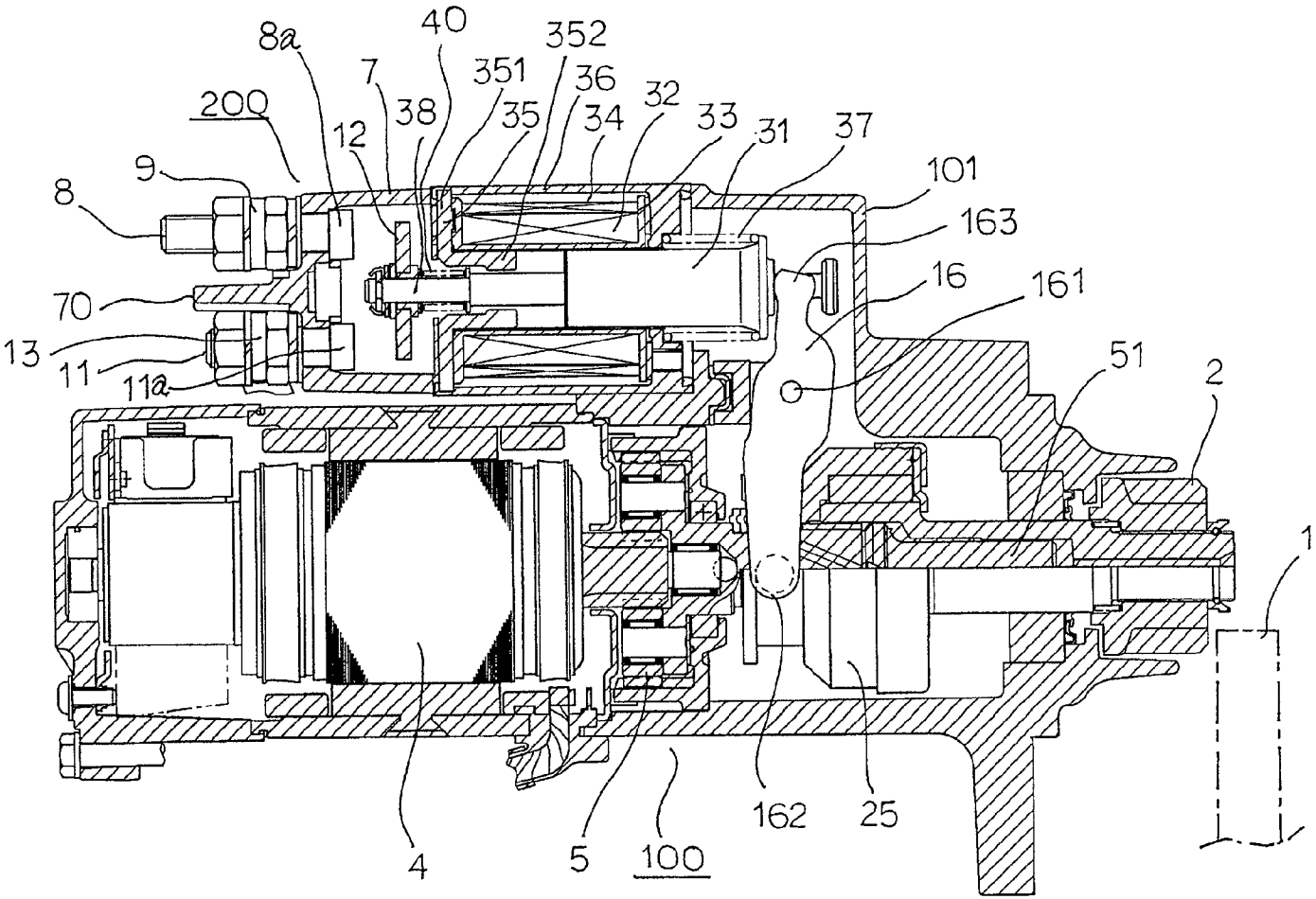
FIG. 1 is a cross-sectional view of a stator equipped with an electromagnetic switch for a starter according to Embodiment 1 of the present invention.
Figure 2:
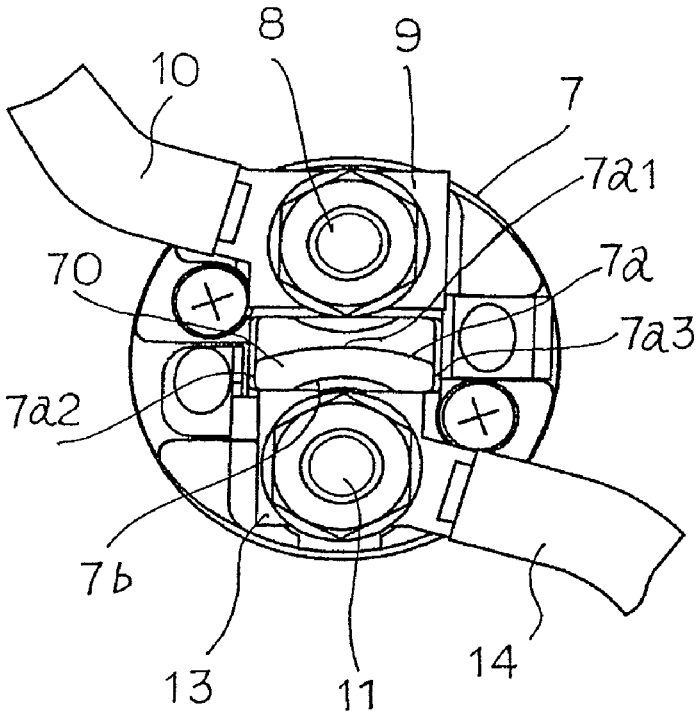
FIG. 2 is an elevation view of the terminal unit of an electromagnetic switch for a starter according to Embodiment 1 of the present invention.
Figure 3:
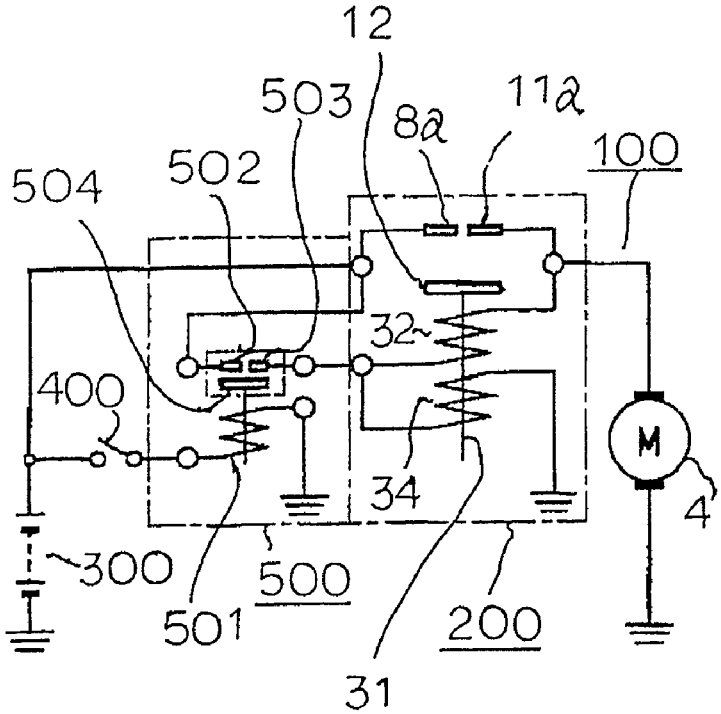
FIG. 3 is a schematic circuit diagram of a stator utilizing an electromagnetic switch for a starter according to Embodiment 1 of the present invention.

An electromagnetic switch for a starter according to Embodiment 1 of the present invention will be explained below. FIG. 1 is a cross-sectional view of a stator equipped with an electromagnetic switch for a starter according to Embodiment 1 of the present invention; FIG. 2 is an elevation view of the terminal unit of an electromagnetic switch for a starter according to Embodiment 1 of the present invention; FIG. 3 is a schematic circuit diagram of a stator utilizing an electromagnetic switch for a starter according to Embodiment 1 of the present invention.

In FIG. 1, a starter 100 is provided with a starter motor 4 for generating torque, a speed reducing unit 5 that is formed of an epicyclic gear mechanism that reduces the rotation speed of the rotor of the starter motor 4 and outputs the torque, an overrunning clutch 25 that is spline-combined with an output axle 51 of the speed reducing unit 5 and movably provided in the axis direction of the output axle 51, and a pinion 2 that is provided in such a way as to slide on the output axle 51 along with the overrunning clutch 25 and to be able to engage with a ring gear 1 of an engine. An electromagnetic switch 200 for a starter, described later, is integrally fixed to a front bracket 101 of the starter 100.

A shift lever 16 is mounted in such a way that it can pivot on a supporting point 161, the middle point thereof; one end 162 of the shift lever 16 is engaged with the overrunning clutch 25; the other end 163 of the shift lever 16 is coupled with one end of a plunger 31 of the electromagnetic switch 200 for a starter. The shift lever 16 and the overrunning clutch 25 are arranged within the front bracket 101.

Next, the electromagnetic switch 200 for a starter will be explained. The electromagnetic switch 200 for a starter is situated above the outer surfaces of the starter motor 4 and the speed reducing unit 5 and is disposed in such a way that the center axis line thereof is approximately parallel to the axis line of the output axle 51 of the starter 100. A cylindrically formed attraction coil 32 is fixed on the outer circumference of an insulative hollow frame 33. A cylindrically formed holding coil 34 is disposed on the outer circumference of the attraction coil 32 in such a way as to be coaxial with the attraction coil 32.

A core 35 formed of a magnetic material has a flange-shaped portion 351 and a cylindrical portion 352; the flange-shaped portion 351 faces respective axis-direction ends of the attraction coil 32 and the holding coil 34 by the intermediary of the hollow frame 33; the cylindrical portion 352 is inserted into the hollow portion of the hollow frame 33. A frame 36 that surrounds the outer circumference of the holding coil 34 is formed of a magnetic material; one axis-direction end thereof is bent radially inward in such a way as to embrace the outer peripheral portion of the flange-shaped portion 351 of the sore 35 so that the core 35 is fixed between the hollow frame 33 and the frame 36. The frame 36 and the core 35 configure part of a magnetic circuit for the attraction coil 32 and the holding coil 34. The plunger 31 formed of a magnetic material is provided in the hollow portion of the hollow frame 33 in such a way as to be able to slide in the axis direction of the hollow frame 33; the plunger 31 is attracted and moved toward the core 35 by the electromagnetic force produced when the attraction coil 32 and the holding coil 34 are energized.

A return spring 37 formed of a compression spring is disposed between the other axis-direction end of the frame 36 and one axial-direction end of the plunger 31 and always biases the plunger 31 along a direction in which the plunger departs from the core 35. A movable contact 12 is fixed on the other axis-direction end of the plunger and is provided on a rod 38 capable of moving in the axis direction of the plunger; the movable contact 12 is always biased by a contact pressure spring 40 formed of a compression spring along a direction in which it departs from the plunger 31.

One axis-direction end of a switch cap 7 made of an insulator such as a synthetic resin is formed as an open end, and the other axis-direction end thereof is formed as a closed end. The ring-shaped end face of the switch cap 7 is fixed to the frame 36 in such a way as to make contact with the one axis-direction end of the frame 36. The movable contact 12 is contained in a switch cap 7 fixed to the frame 36.

As illustrated in FIGS. 1 and 2, a battery terminal 8 and a motor terminal 11 are fixed in the switch cap 7 in such a way as to penetrate the closed end of the switch cap 7 in the axis direction of thereof. When the starter 100 is mounted in a vehicle, the battery terminal 8 is situated approximately perpendicularly above the motor terminal 11. A battery fixed contact 8*a* and a motor fixed contact 11*a* are adhered and electrically connected to one end of the battery terminal 8 and one end of the motor terminal 11, respectively. A battery terminal strip 9 connected with a battery cable 10 and a motor terminal strip 13 connected with a motor lead 14 are connected with the battery terminal 8 and the motor terminal 11, respectively, at the outside of the switch cap 7.

A diaphragm 70 that is formed on the outer surface of the closed end of the switch cap 7 is to ensure a sufficient creepage distance between the battery terminal 8 and the motor terminal 11; the diaphragm 70 extends along the center axis of the switch cap 7 and is situated between the battery terminal 8 and the motor terminal 11. A wall face 7*a*, of the diaphragm 70, that faces the battery terminal 8 is formed in the shape of a protrusion that has a vertex portion 7*a*1 at approximately middle of the width of the wall face 7*a*, and whose sides gradually slant from the vertex portion 7*a*1 toward respective transverse-direction ends 7*a*2 and 7*a*3. A wall face 7*b*, of the diaphragm 70, that faces the motor terminal 11 is formed in a concave shape.

Next, in FIG. 3, which is a schematic circuit diagram of the starter, the battery fixed contact 8*a* of the electromagnetic switch 200 for a starter is connected with the positive-polarity terminal of a battery 300 mounted in a vehicle. A starter relay 500 is provided with a relay coil 501; one end of the relay coil 501 is connected with the positive-polarity terminal of the battery 300 via a key switch 400. The starter relay 500 includes a pair of relay fixed contacts 502 and 503, and a relay movable contact 504 that is moved when the relay coil 501 is energized and makes contact with the pair of relay fixed contacts 502 and 503.

The relay fixed contact 502 of the starter relay 500 is connected with the battery fixed contact 8*a* of the electromagnetic switch 200 for a starter; the relay fixed contact 503 is connected with one terminal of the attraction coil 32 and one terminal of the holding coil 34 of the electromagnetic switch 200 for a starter. The motor fixed contact 11*a* of the electromagnetic switch 200 for a starter is connected with the other terminal of the attraction coil 32 and one terminal of the armature coil of the starter motor 4.

In FIGS. 1 and 3, when the key switch 400 is turned on, the relay coil 501 in the starter relay 500 is energized; thus, the relay movable contact 504 is moved to make contact with the pair of relay fixed contacts 502 and 503; then, the pair of relay fixed contacts 502 and 503 are short-circuited. As a result, electric currents flow in the attraction coil 32 and the holding coil 34 in the electromagnetic switch 200 for a starter; the attraction coil 32, the holding coil 34, the frame 36, the flange-shaped portion 351 and the cylindrical portion 352 of the core 35, and the plunger 31 form a magnetic circuit; then, the plunger 31 is attracted toward the core 35. Accordingly, the plunger 31 resists the biasing force exerted by the return spring 37 and travels toward the core 35.

Due to the travel of the plunger 31, the shift lever 16 pivots on the supporting point 161 in the counterclockwise direction with respect to the paper plane of FIG. 1. Due to the pivot of the shift lever 16, the one end 162 thereof makes contact with the overrunning clutch 25, so that the overrunning clutch 25 and the pinion 2 are moved rightward with respect to the paper plane of FIG. 1. As a result, the end face of the pinion 2 makes contact with the end face of the ring gear 1, whereupon the pinion 2 once stops its traveling; however, on the other hand, because a relatively small current flows in the armature of the starter motor 4 via the relay fixed contact 502, the relay movable contact 504, and the relay fixed contact 503 of the starter relay 500, and the attraction coil 32 of the electromagnetic switch 200 for a starter, the starter motor 4 rotates at a relatively low speed; therefore, the rotation of the starter motor 4 is transferred to the pinion 2 via the speed reducing unit 5 and the overrunning clutch 25, so that the pinion rotates.

Because the pinion 2 rotates in such a way as described above, the pinion 2 and the ring gear 1 engage with each other. At the time instant when the pinion 2 and the ring gear 1 have almost completely engaged with each other, a short circuit between a pair of fixed contacts 8*a* and 11*a* of the electromagnetic switch 200 for a starter is made by the movable contact 12; an large electric current flows from the battery 300 to the starter motor 4; the high-speed rotation of the starter motor 4 is transferred to the pinion 2 via the speed reducing unit 5 and overrunning clutch 25; then, the pinion 2 rotates at high speed so as to crank the engine via the ring gear 1.

As described above, the wall face 7*a* of the diaphragm 70 provided in the switch cap 7 is formed in the shape of a protrusion that has the vertex portion 7*a*1 at approximately middle of the width of the wall face 7*a*, and whose sides gradually slant from the vertex portion 7*a*1 toward respective transverse-direction ends 7*a*2 and 7*a*3; therefore, even in the case where the terminal portion of the electromagnetic switch 200 for a starter is flooded with water, the water does not remain on the wall face 7*a* of the diaphragm 70 but is immediately drained away.

As described above, in the electromagnetic switch for a starter according to Embodiment 1 of the present invention, even in the case where the electromagnetic switch is flooded with water, the water does not remain on the wall face 7*a* but is immediately drained away from the diaphragm 70; thus, there can be prevented the occurrence of a defect caused by a leakage circuit formed between the battery terminal and the motor terminal.

Embodiment 2

Figure 4:
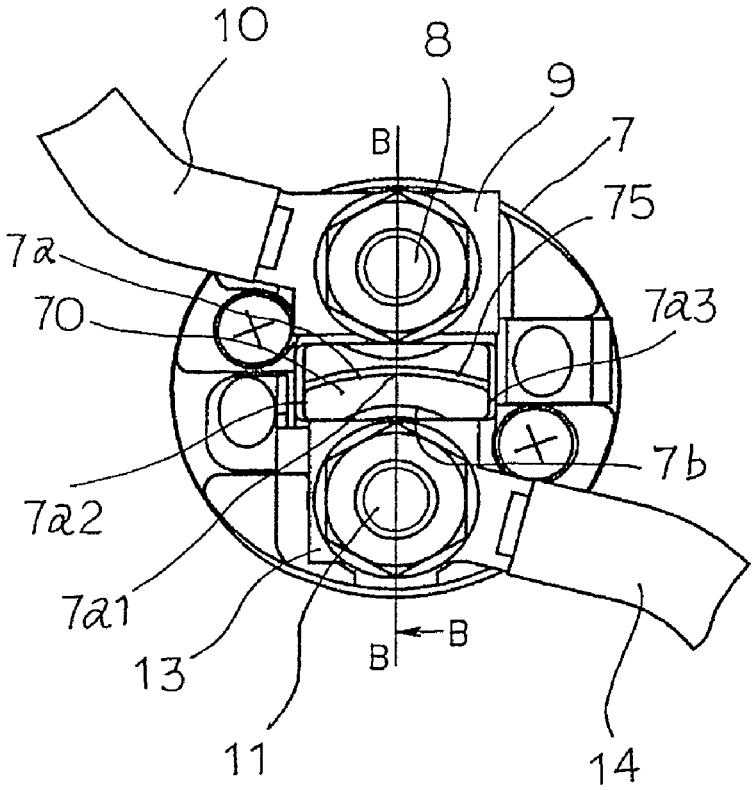
FIG. 4 is an elevation view of the terminal unit of an electromagnetic switch for a starter according to Embodiment 2 of the present invention.
Figure 5:
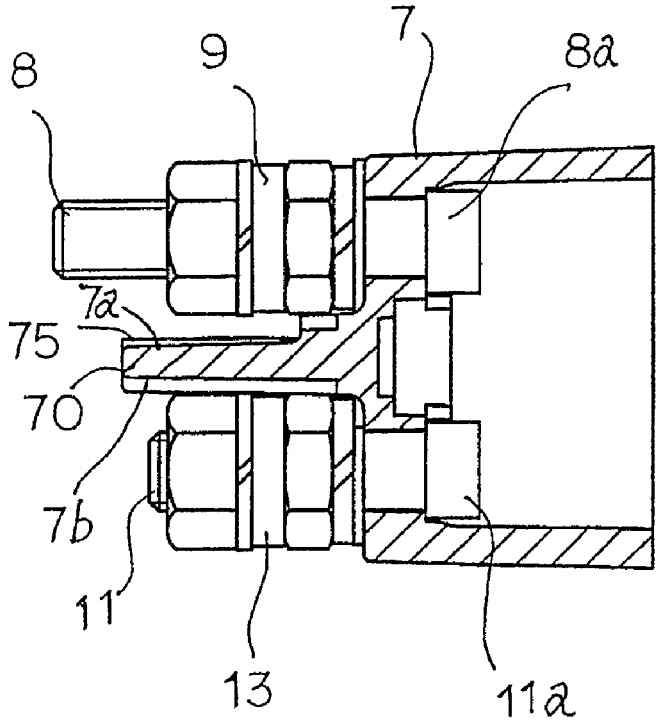
FIG. 5 is a cross-sectional view of the terminal unit in FIG. 4 in the case where the cross section taken along the line B-B is viewed along the arrow B.
Figure 6:
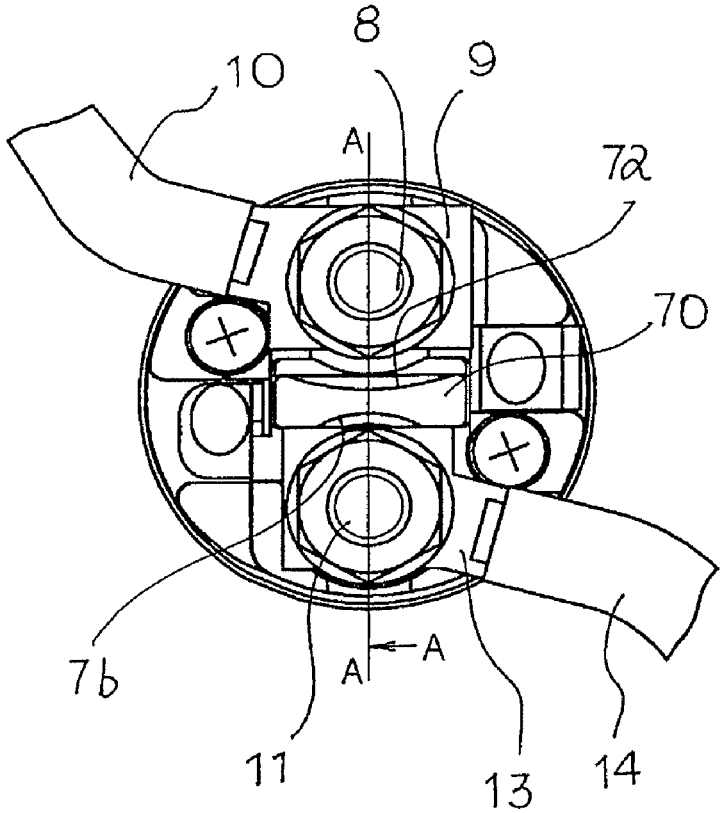
FIG. 6 is an elevation view of the terminal unit of a conventional electromagnetic switch for a starter.
Figure 7:
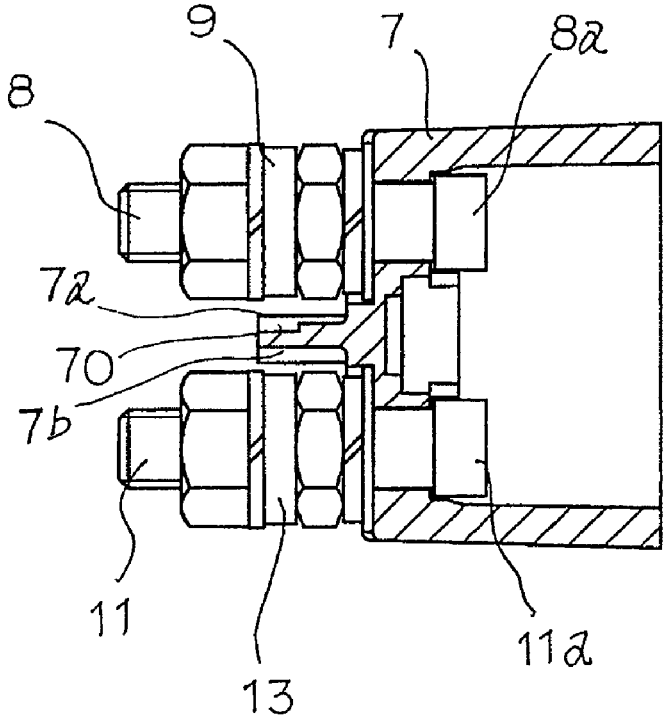
FIG. 7 is a cross-sectional view of the terminal unit in FIG. 6 in the case where the cross section taken along the line A-A is viewed along the arrow A.

Next, an electromagnetic switch for a starter according to Embodiment 2 of the present invention will be explained. FIG. 4 is an elevation view of the terminal unit of an electromagnetic switch for a starter according to Embodiment 2 of the present invention; FIG. 5 is a cross-sectional view of the terminal unit in FIG. 4 in the case where the cross section taken along the line B-B is viewed along the arrow B.

In FIGS. 4 and 5, a wall face 7*a* of a diaphragm 70 formed in the outer surface of the closed end of a switch cap 7 is formed in the shape of a protrusion that has a vertex portion 7*a*1 at approximately middle of the width of the wall face 7*a*, and whose sides gradually slant from the vertex portion 7*a*1 toward respective transverse-direction ends 7*a*2 and 7*a*3. A wall face 7*b*, of the diaphragm 70, that faces a motor terminal 11 is formed in a concave shape. A water-repellent coating 75 having a nature of repelling water is provided over the whole area of the wall face 7*a* of the diaphragm 70. As illustrated in FIG. 5, the motor terminal 11 is formed in such a way as to be shorter in the axis direction thereof than the diaphragm 70 that extends in the axis direction of the switch cap 7.

Other configurations are the same as those in Embodiment 1 described above.

As described above, the wall face 7*a* of the diaphragm 70 is formed in the shape of a protrusion that has the vertex portion 7*a*1 at approximately middle of the width of the wall face 7*a*, and whose sides gradually slant from the vertex portion 7*a*1 toward respective transverse-direction ends 7*a*2 and 7*a*3, and the water-repellent coating 75 is provided on the wall face 7*a*; therefore, even in the case where the terminal portion of the electromagnetic switch 200 for a starter is flooded with water, the water does not remain on the wall face 7*a* of the diaphragm 70 but is immediately drained away.

As described above, in the electromagnetic switch for a starter according to Embodiment 2 of the present invention, due to the water-repellent effect of the water-repellent coating 75 and the protrusive shape of the wall face 7*a* of the diaphragm 70, flood water is further rapidly drained away from the diaphragm 70; thus, the occurrence of a defect caused by a leakage circuit formed between the battery terminal and the motor terminal can be prevented.

Moreover, in the electromagnetic switch for a starter according to Embodiment 2 of the present invention, the motor terminal 11 is formed in such a way as to be shorter in the axis direction thereof than the diaphragm 70 that extends in the axis direction of the switch cap 7; therefore, in the case where the terminal portion of the electromagnetic switch 200 for a starter is flooded with water, the water that starts to flow from the axis-direction front end of the diaphragm 70 does not adhere to the motor terminal 11, whereby a defect caused by a leakage circuit formed between the battery terminal 8 and the motor terminal 11 can more securely be prevented.

In addition, in the case of Embodiment 2 described above, the wall face 7*a* of the diaphragm 70 is formed in such a way as to be protrusive, as is the case with Embodiment 1, and the water-repellent coating 75 is provided on the wall face 7*a*; in addition to that, the motor terminal 11 is formed in such a way as to be shorter in the axis direction thereof than the diaphragm 70 that extends in the axis direction of the switch cap 7. However, the electromagnetic switch for a starter may be configured in such a way that, as is the case with Embodiment 1, the wall face 7*a* of the diaphragm 70 is formed in such a way as to be protrusive, but no water-repellent coating is provided on the wall face 7*a* of the diaphragm 70, and the motor terminal 11 is formed in such a way as to be shorter in the axis direction thereof than the diaphragm 70 that extends in the axis direction of the switch cap 7. In this case, due to the protrusive shape of the wall face 7*a* of the diaphragm 70, flood water is further rapidly drained away from the diaphragm 70, and the water that starts to flow from the axis-direction front end of the diaphragm 70 does not adhere to the motor terminal 11; therefore, a defect caused by a leakage circuit formed between the battery terminal 8 and the motor terminal 11 can securely be prevented.

Various modifications and alterations of this invention will be apparent to those skilled in the art without departing from the scope and spirit of this invention, and it should be understood that this is not limited to the illustrative embodiments set forth herein.

What is claimed is:

1. An electromagnetic switch for a starter comprising:

an electromagnetic coil that is energized when a key switch is turned on;

a plunger that is driven by electromagnetic force produced across the energized electromagnetic coil, thereby traveling in a predetermined direction;

a pair of fixed contacts that are spaced apart from each other;

a movable contact that travels due to a travel of the plunger and makes contact with the pair of fixed contacts so as to make a short circuit across the pair of fixed contacts;

a switch cap that is made of an insulative material and incorporates the pair of fixed contacts and the movable contact;

a battery terminal that is connected with one of the pair of fixed contacts and is disposed in such a way as to be exposed outside the switch cap; and a motor terminal that is connected with the other one of the pair of fixed contacts and is disposed in such a way as to be exposed outside the switch cap, electric power being supplied from a battery connected with the battery terminal to a starter motor connected with the motor terminal, when the movable contact makes a short circuit across the pair of fixed contacts, wherein, on the outer surface thereof, the switch cap is provided with a diaphragm disposed between the battery terminal and the motor terminal; and the diaphragm is formed in such a way that a wall face thereof, that faces the battery terminal, protrudes convexly toward the battery terminal.

2. The electromagnetic switch for a starter according to claim 1, wherein the longitudinal-direction front end of the motor terminal is closer to the switch cap than the longitudinal-direction front end of the diaphragm.

3. The electromagnetic switch for a starter according to claim 1, wherein a water-repellent coating is provided on the wall face of the diaphragm that faces the battery terminal.

4. The electromagnetic switch for a starter according to claim 3, wherein the longitudinal-direction front end of the motor terminal is closer to the switch cap than the longitudinal-direction front end of the diaphragm.

* * * * *